United States Patent [19]

Wormmeester et al.

[11] 4,046,265

[45] Sept. 6, 1977

[54] LOADING AND UNLOADING BRIDGE FOR CONTAINERS

[75] Inventors: Gerhardus J. Wormmeester, Zwijndrecht; Joannes C. Rijsenbrij, Boskoop, both of Netherlands

[73] Assignee: Europe Container Terminus B.V., Rotterdam, Netherlands

[21] Appl. No.: 663,137

[22] Filed: Mar. 2, 1976

[30] Foreign Application Priority Data

Mar. 4, 1975 Netherlands ..... 7502542

[51] Int. Cl.[2] ..... B63B 27/00

[52] U.S. Cl. ..... 214/14; 212/18; 214/38 CA

[58] Field of Search ..... 212/56, 46, 10, 11, 212/12, 13, 14, 15, 16, 17, 18, 19, 20, 21, 22, 23, 24, 25, 26, 27; 214/38 CA, 16.4 A, 14, 87, 88, 104, 96, 97

[56] References Cited

U.S. PATENT DOCUMENTS 1,404,947 1/1922 Fitch ..... 214/38 CA 3,471,040 10/1969 Field ..... 214/14

3,812,987 5/1974 Watatani ..... 214/14

*Primary Examiner*—Lawrence J. Oresky

*Attorney, Agent, or Firm*—Finnegan, Henderson, Farabow & Garrett

[57] ABSTRACT

A crane device for loading and unloading containers cnto a ship including a horizontal main girder and an inclined beam extending from a position under the main girder to a position above and near the ground. A supporting platform is on the crane between the main girder and the upper end of the inclined beam. A first trolley is moveable along the main girder and includes a hoist for transporting containers between the ship and the supporting platform. A second trolley is moveable along the inclined beam and includes a hoist for transporting containers between the supporting platform and a carriage on the ground. The crane further includes a transport mechanism including a positionable arm operable to push carriages in a direction generally transverse to the inclined beam.

5 Claims, 4 Drawing Figures

LOADING AND UNLOADING BRIDGE FOR CONTAINERS

The invention relates to a loading and unloading bridge for containers including a travelling crab which is movable along a beam construction.

Such a bridge is intended for removing containers out of or from a ship and depositing them on a vehicle positioned on the quay and for transferring containers from the quay into or onto a ship.

In a known construction a single travelling crab provides for the entire transportation from the ship to the quay and vice versa. This has the disadvantage that the bridge has a low capacity. In view of the length of the hoisting cables extending from the travelling crab there are positioning problems, which involve an additional loss of capacity.

It has been comtemplated to provide a loading and unloading bridge with two travelling crabs, that is a first horizontally movable crab for transferring containers from a ship to a platform arranged closely below the track of that crab (or vice versa) and a second horizontally movable crab for transferring the containers from the platform to the floor (or vice versa). This would increase the capacity and at the same time provide the possibility of depositing a number of containers on the relatively high platform (buffering). A difficulty is, however, that the hoisting cables of the second travelling crab are relatively long so that positioning problems also arise in depositing the containers on the floor. Besides, this construction is not readily suitable for automation. Moreover, both travelling crabs require a separate operator.

The object of the invention is to overcome the objections of the above-mentioned loading and unloading bridges and to provide a loading and unloading bridge of the type described with which it can be achieved that no or hardly any positioning problems arise, that transport tracks are short, that in consequence the capacity is high, that the construction is also suitable for buffering containers during the loading and unloading procedure, while in principle one operator would suffice.

To that end, according to the invention, the aforesaid loading and unloading bridge is characterized in that a supporting platform for at least one container is arranged at a considerable distance below said horizontal beam construction and that an inclined beam construction for a second travelling crab extends from a certain distance above said supporting platform to a certain distance above a track for carriages arranged or plotted on the floor beneath the bridge.

The crab travelling along an inclined track has very short hoisting cables, that is to say there are no positioning problems. Buffering can take place on the carriages at floor level. The system is perfectly suitable for automation by simple means, the cycle time being in principle determined by the first horizontally moving crab.

For ease of operation and as a condition for automation it is strongly preferred that the bridge is provided with means for displacing the carriages through a fixed stroke.

These carriage displacing means may advantageously consist of an arm which is secured to a transport mechanism and is adapted to be hooked behind or in the carriages and to be switched between an operative and an unoperative position.

If the vertical distance from the inclined beam construction to the supporting platform substantially corresponds with the vertical distance from the inclined beam construction to the carriage floors it can be arranged for the transfer of containers from the supporting platform to the carriages and vice versa to take place entirely automatically. In order to optimise the cycle time it is preferred that the supporting platform is situated 10 to 15 meters above floor level.

An additional advantage of the afore-said construction is that existing cranes may be readily converted or complemented according to the invention.

The invention will now be explained in detail with reference to a preferential embodiment shown by way of example in the drawing.

Figure 1:
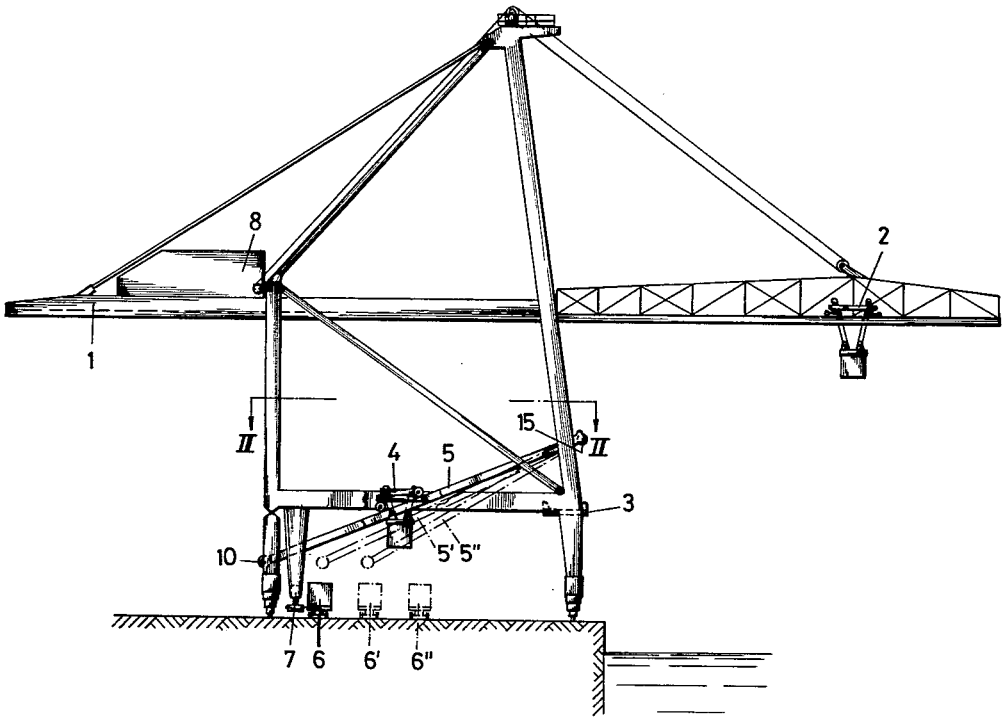
FIG. 1 is an elevational view of a loading and unloading bridge according to the invention.

The loading and unloading bridge for containers shown in the drawing comprises a first travelling crab 2 which is movable along a horizontal beam construction 1, a supporting platform 3 arranged at a considerable distance below the horizontal beam construction 1 and a second travelling crab 4 which is movable along an inclined beam construction 5. This inclined beam construction extends from a fairly small distance above the platform 3 to the same distance above the floor of a carriage which has been moved to a position beneath the bridge and generally forms part of a series of carriages passing beneath the bridge in a fixed track.

Such a track is indeed arranged or plotted beneath the bridge.

The bridge is further equipped with means generally indicated at 7 for permitting displacement of the carriages 6 through a fixed stroke.

At the level of the horizontal beam construction 1 for the first travelling crab 2 a cabin 8 is provided which includes the usual winches and drive machinery for that crab.

For unloading a container from a ship to a certain location on the quay that container is first lifted out of or from the ship by means of the travelling crab 2 and the yoke cooperating therewith and placed on the platform 3 which is provided with corner guides 9. Within the space of time during which the travelling crab 2 is engaged on fetching up a next container, the container deposited on the platform 3 is lifted by means of the travelling crab 4 and the yoke depending therefrom and transferred along an inclined path to a position right above a carriage 6 and deposited on the floor of that carriage by lowering the yoke. The distance through which the yoke with the container connected thereto is hoisted above the platform 3 corresponds with the distance through which the yoke is lowered above the floor of the carriage 6. In view of this the vertical distance from the inclined beam construction 5 to the platform 3 preferably corresponds with the vertical distance from the inclined beam construction 5 to the floors of the carriages 6.

As soon as a container is placed on the floor of a carriage 6 the series of carriages is so displaced by means 7 that a next carriage takes up the correct position for receiving a next container. In the meantime, the travelling crab 4 returns to the position above the platform 3 for fetching up a next container.

The cycle time of the travelling crab 4 is in principle less than the cycle time of the travelling crab 2. This is achieved by the comparatively short displacement path of the crab 4 and as a result of the fact that the yoke of the crab 4 is raised and lowered through short and constant distances.

It will be understood that the described loading and unloading bridge is suitable for automated operation; after a container has been suspended from the yoke of the travelling crab 2 its transfer to a carriage 6 and the displacement of that carriage occurs automatically according to a determinate stroke. Therefore, in principle only one operator is required. The capacity of the loading and unloading bridge will be relatively high. Buffering container, that is to say storing a limited number of containers which cannot be immediately passed on during a fairly short time, takes place by means of the carriages 6 beneath the loading and unloading bridge and not by means of the platform 3.

Seen in the longitudinal direction of the quay, a number of substantially identical bridges may be arranged behind the illustrated loading and unloading bridge. Each of those bridges has its own plotted track for the carriages (drawn with dash-dot lines and indicated with 6' and 6''). Obviously, also the angle of inclination of the guide beams for the travelling crab 4 has been adapted to the position of the carriage 6' and 6''. These guide beams are drawn with dash-dot lines and indicated with 5' and 5''.

Figure 2:
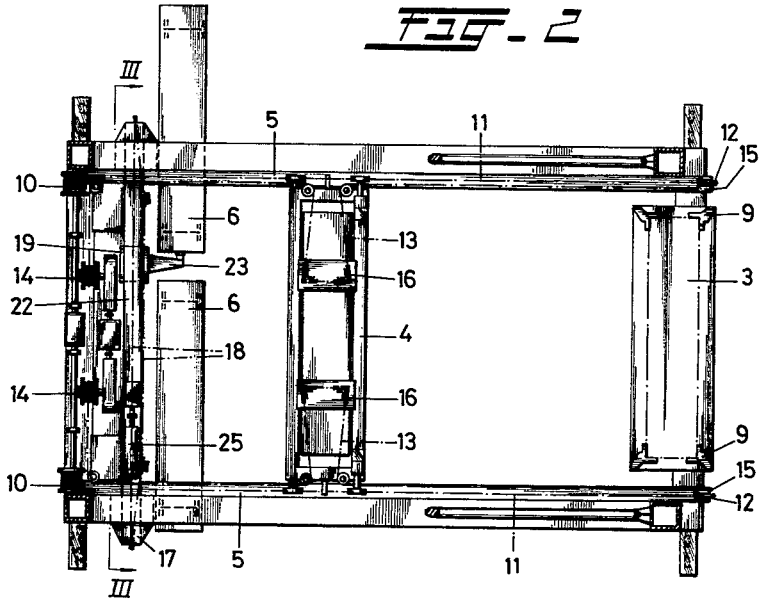
FIG. 2 is a sectional view along the line II—II in FIG. 1 on a larger scale.
Figure 3:
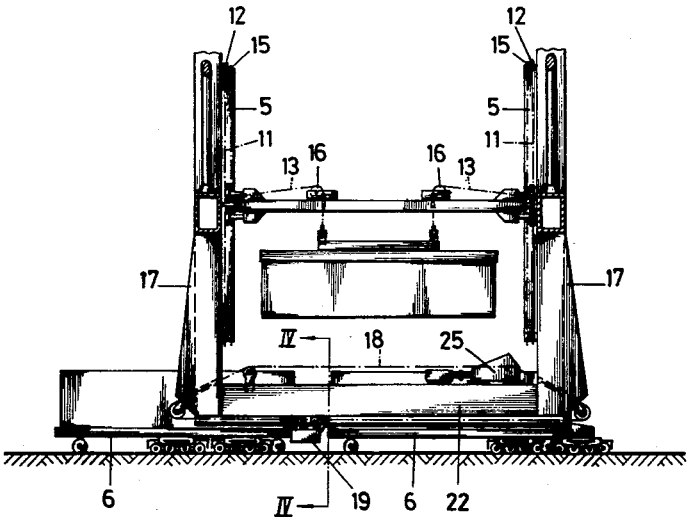
FIG. 3 is a sectional view along the line III—III in FIG. 2.

In FIG. 2 it can be seen that the travelling crab 4 is driven by means of cables 11 passing over winches 10. At the end of the beams 5 opposite the winches these cables are passed over pulleys 12.

The hoisting cables 13 for the travelling crab 4 extend from the winches 14 to a fixed point 15 at the end of the beams 5 opposite the winches. At the travelling crab 4 those cables pass over a number of pulleys 16, one thing and another in such a manner that during displacement of the crab the pulleys 16 roll along the cables 13. The advantage of this construction is that the crab 4 can be made relatively light.

The displacement means for the carriages 6 are arranged between the lower ends of a set of beams 17 connected to the loading and unloading bridge. These means consist of a box 19 which can be pulled to-and-fro by a cable 18 and is provided with horizontal and vertical wheels 20 guided by and rolling on rails 21 which are secured to a horizontal beam 22. The box has a swinging arm 23 pivoted thereto of which the end is pivotally connected to a screw spindle of a hydraulic or pneumatic cylinder 24.

Figure 4:
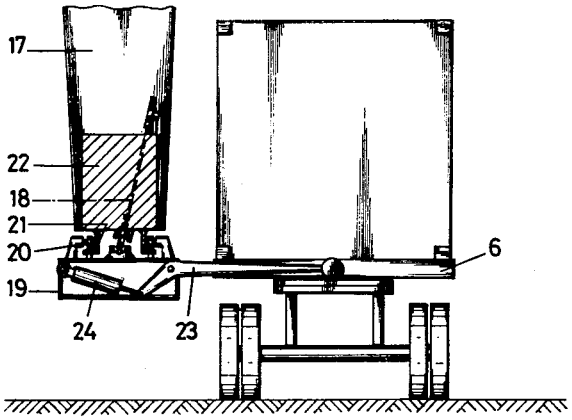
FIG. 4 shows a detail on a still larger scale of the displacing means for carriages disposed beneath the bridge.

The cable 18 passes over various pulleys one of which is driven by a unit 25. For displacing the carriages 6 the arm 23 is swung out to its position behind the carriages 6 shown in FIGS. 2 and 4. Subsequently, the cable 18 is driven through a predetermined distance approximately corresponding with the length of a carriage. After the arm has been swung up by means of the cylinder 24 the cable 18 is driven in the opposite direction until the box 19 has returned to the starting position.

Various modifications are possible within the scope of the claims. Essential for the invention is the travelling crab 4 which is displacable along an inclined track between a certain distance above the supporting platform 3 and a small distance above the floor. The displacement means 7 which do not necessarily form part of the bridge are further of great importance.

We claim:

1. A portable container crane moveable along the ground comprising a horizontal main girder adapted to extend over a ship, a first trolley moveable along said main girder, a supporting platform mounted in a fixed position on said portable crane beneath said main girder and adapted to support at least one container, an inclined beam mounted in a fixed position on said portable crane extending from a position above said supporting platform to a position above and near the ground, a second trolley moveable along said inclined beam, said first trolley having hoist means for transporting containers between said ship and said supporting platform, said second trolley having hoist means for transporting containers from said supporting platform and a carriage on the ground, the inclination of said inclined beam serving to facilitate rapid transfer of containers from said supporting platform to a carriage on the ground.

2. A container crane according to claim 1 where the vertical distance between said inclined beam structure and said platform is substantially equal to the vertical distance between said inclined beam structure and the normal level of the bottom of said carriage on the ground.

3. A container crane according to claim 1 where the cycle time of said second trolley is less than the cycle time of said first trolley.

4. A portable container crane moveable along the ground comprising a horizontal main girder adapted to extend over a ship, a first trolley moveable along said main girder, a supporting platform mounted in a fixed position on said portable crane beneath said main girder and adapted to support at least one container, an inclined beam mounted in a fixed position on said portable crane extending from a position above said supporting platform to a position above and near the ground, a second trolley moveable along said inclined beam, said first trolley having hoist means for transporting containers between said ship and said supporting platform, said second trolley having hoist means for transporting containers between said supporting platform and the carriage on the ground, the inclination of said inclined beam serving to facilitate rapid transfer of containers from said supporting platform to a carriage on the ground, said crane further including means for pushing carriages located on the ground adjacent said inclined beam away from said inclined beam.

5. A container crane according to claim 4 wherein said carriage pushing means includes arm means secured to a transport mechanism and moveable in a direction transverse to said inclined beam, said arm means being positionable in an operable position engageable with a carriage adjacent said inclined beam, and in an inoperative position withdrawn from said carriage.

* * * * *